US010155171B2

(12) United States Patent
Crawford et al.

(10) Patent No.: US 10,155,171 B2
(45) Date of Patent: Dec. 18, 2018

(54) TRACK-BASED SWING RIDE WITH LONG ARM PENDULUM

(71) Applicant: DISNEY ENTERPRISES, INC., Burbank, CA (US)

(72) Inventors: David W. Crawford, Long Beach, CA (US); Derek Lee Howard, Pasadena, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 336 days.

(21) Appl. No.: 15/088,326

(22) Filed: Apr. 1, 2016

(65) Prior Publication Data

US 2017/0282085 A1 Oct. 5, 2017

(51) Int. Cl.

| | |
|---|---|
| ***A63G 21/08*** | (2006.01) |
| ***A63G 27/02*** | (2006.01) |
| ***A63G 31/02*** | (2006.01) |
| ***A63G 21/20*** | (2006.01) |

(52) U.S. Cl.

CPC ..... *A63G 21/08* (2013.01); *A63G 21/20* (2013.01); *A63G 27/02* (2013.01); *A63G 31/02* (2013.01)

(58) Field of Classification Search

CPC ..... A63G 21/08; A63G 21/20; A63G 21/22; A63G 27/02; A63G 27/08; B61B 3/02

USPC ..... 104/74–76, 92

See application file for complete search history.

(56) References Cited

U.S. PATENT DOCUMENTS

| | | | | |
|---|---|---|---|---|
| 6,606,953 | B2 * | 8/2003 | Mares | A63G 1/00 104/63 |
| 6,871,596 | B2 * | 3/2005 | De-Gol | A63G 1/34 104/53 |
| 7,610,859 | B1 * | 11/2009 | Dietrich | A63G 21/08 104/53 |
| 7,806,054 | B2 * | 10/2010 | Baker | A63G 7/00 104/53 |
| 7,921,781 | B2 * | 4/2011 | Baker | A63G 7/00 104/60 |
| 8,066,576 | B2 * | 11/2011 | Threlkel | A63G 7/00 104/53 |
| 8,141,495 | B2 * | 3/2012 | Baker | A63G 7/00 104/60 |
| 8,176,853 | B2 * | 5/2012 | Nemeth | A63G 7/00 104/139 |
| 8,360,893 | B2 * | 1/2013 | Howard | A63G 21/08 104/53 |

(Continued)

*Primary Examiner* — Zachary L Kuhfuss

(74) *Attorney, Agent, or Firm* — Marsh Fischmann & Breyfogle LLP; Kent A. Lembke

(57) ABSTRACT

A track-based swing ride system providing passengers a unique swinging ride experience. The ride system includes a ride track that supports a moving bogie coupled to the ride track that includes a drive assembly driving the bogie along a ride path defined by the ride track. The ride apparatus includes a pendulum arm pivotally coupled at a first end to the bogie, whereby the pendulum arm is suspended below the ride track and moves along the ride path with the bogie. The ride apparatus includes a passenger vehicle coupled to a second end of the pendulum arm opposite the first end of the pendulum arm. To provide the swinging sensation, the ride apparatus includes a roll driver rotating, concurrently with the drive assembly of the bogie, the pendulum arm about a roll axis extending through the first end of the pendulum arm.

14 Claims, 8 Drawing Sheets

(56) References Cited

U.S. PATENT DOCUMENTS

| | | | | |
|---|---|---|---|---|
| 8,453,576 | B2 * | 6/2013 | Roodenburg | A63G 21/20 104/53 |
| 9,486,135 | B1 * | 11/2016 | Fram | B61B 3/02 |
| 9,643,094 | B2 * | 5/2017 | White | A63G 21/08 |
| 9,962,617 | B2 * | 5/2018 | Zamperla | A63G 1/24 |

* cited by examiner

TRACK-BASED SWING RIDE WITH LONG ARM PENDULUM

BACKGROUND

1. Field of the Description

The present description relates, in general, to theme or amusement park rides, and, more particularly, to an amusement park ride providing passengers with a unique ride experience including vehicles with a swinging passenger compartment.

2. Relevant Background

Amusement and theme parks are popular worldwide with hundreds of millions of people visiting the parks each year. Park operators continuously seek new designs for rides that attract and entertain guests in new ways. Many parks include swing rides or rides that include a swinging passenger vehicle. However, there has been little advancement or change in these rides over the past decades. Such ride "staleness" can result in decreased enthusiasm in park visitors as the ride experience has become known and predictable, which can result in fewer first or at least in fewer repeat rides by park visitors.

There are a variety of well-known rides with swinging vehicles that are presently in use in amusement and theme parks. A conventional swing vehicle ride may use a round or flat ride configuration in which the passengers get in a chair or a vehicle with other passengers, and the center hub rotates about its axis with the passengers in their chairs or vehicles swung further and further outward (at a larger and larger radius) with increasing rotation speeds (and vice versa). The radius at which the ride is positioned relative to the center rotation axis is determined by speed of rotation (and weight of the passenger and the chair/vehicle) in most cases such that the swinging aspect of the ride experience is passive (e.g., not powered). Other systems have actuators that actively force the arms to swing.

In other swing rides, passenger vehicles are hung from a long rod or arm, and a motor is used to rotate the arm about a rotation axis passing through the arm at the end opposite the vehicles. The passenger vehicle is then "dropped" from a desired height, and the vehicle swings back and forth on the end of the arm about the rotation axis. The passengers typically are arranged to face in a direction orthogonal to the rotation axis so in one rotation or swinging direction (such as a clockwise rotation) the passengers are facing forward in the direction of swinging travel and in the other rotation or swinging direction (such as counterclockwise rotation) the passengers are facing away from the direction of swinging travel (e.g., they are dropped backward through the swing). The ride experience is much like that of a school yard swing but on a much larger scale.

Swinging sensations have also been provided in other types of rides. For example, many conventional roller coasters involve launching a vehicle that is suspended from a track. The vehicle may be free to pivot or rotate about its coupling with the track such that the passengers in the vehicle will have the sensation of flying outward as the vehicle rapidly travels around or banks curves in the track. The rotation or swinging of the vehicle is not powered (and neither is the roller coaster vehicle) but is instead dependent on the dynamics imparted to the vehicle from the track and speed of the vehicle.

SUMMARY

Briefly, an amusement park ride is described that addresses the need for a new ride experience that includes providing passengers or riders with the sensation or feeling of swinging through a ride space like a character from a story or movie such as the fictional character Tarzan. The inventors determined that a truly fun and unique experience could be provided by combining side-to-side swinging of a passenger vehicle as it travels along a ride path on a suspended track above the vehicle.

To implement this ride idea, a long support arm or pendular arm is used to support a passenger vehicle at one end while the other end is pivotally supported proximate to a bogie that is powered to travel in a direction of travel (DOT) along a track at a range of bogie velocities (or ride speeds). The pendulum arm is "long" in that it typically supports the passenger vehicle 6 to 30 feet below the track (with some designs using a distance of 6 to 15 feet from the roll axis to provide a desired swing sensation). Concurrently, a drive mechanism (or roll driver) is operated to cause the pendulum arm to rotate through a plurality of roll angles to cause the supported passenger vehicle to swing back and forth (or side-to-side) relative to the DOT and the ride track. The roll axis passes through the pendulum arm at a location distal to the passenger vehicle and is parallel to and aligned with the center axis of the track and the DOT of the bogie.

The roll driver is operated in a manner to simulate real world or natural swinging in some cases such as by providing faster roll movement at the bottom of the swing (with a small roll angle relative to vertical) and a much slower roll movement at the tops of each swing (e.g., the roll driver may actually halt or pause movement for a short period of time before "dropping" the passenger vehicle and pendulum arm through another swinging motion). The operation of the roll driver to provide clockwise (CW) and (CCW) rotation of the pendulum arm about the roll axis is synchronized (e.g., by a controller running a pendulum ride program) with operation of the bogie drive assembly to provide a desired experience of natural swinging.

For example, the bogie's velocity along the track and in the DOT may be varied (e.g., pulsed) so that it is in higher ranges when the pendulum arm is in a range of smaller roll angles (e.g., fastest bogie velocity may occur when the pendulum arm is hanging straight down from the track and the bogie) and is in lower ranges when the pendulum arm is in a range of higher roll angles (e.g., slower bogie velocities may be used in the ride when the pendulum arm is rotated outward significantly (e.g., into roll angles of CW or CCW 45 to 60 degrees or more as measured from vertical). From this brief overview, it will be clear why the new ride may be labeled a track-based swing ride with a long arm pendulum with the combination of a powered bogie and a powered movement of a passenger vehicle about a roll axis providing an exciting and, typically, natural swing sensation that will surprise passengers and result in many repeating the ride again and again.

More particularly, a swing ride apparatus is provided that gives passengers a unique swinging ride experience. The ride apparatus includes a ride track. The ride apparatus also includes a bogie coupled to the ride track (e.g., rollably engaging the ride track), and the bogie includes a drive assembly operable to drive the bogie along a ride path defined by the ride track (e.g., at velocities defined in a motion profile for each location or section of the ride track). Significantly, the ride apparatus includes a pendulum arm pivotally coupled at a first end to the bogie, whereby the pendulum arm is suspended below the ride track and moves along the ride path with the bogie. Further, the ride apparatus includes a passenger vehicle coupled to a second end of the pendulum arm opposite the first end of the pendulum arm.

To provide the swinging sensation, the ride apparatus includes a roll driver (e.g., a motor, an actuator, or the like) operable, concurrently with the drive assembly of the bogie, to rotate the pendulum arm about a roll axis extending through the first end of the pendulum arm. In this way, the swinging sensation feels like a forward swinging motion because the vehicle is moved with both translational motion and with a side-to-side pendulum-based swing.

In some implementations, the roll driver operates to rotate the pendulum arm through a swing arc defined by a range of roll angles that is transverse to the ride path, whereby the ride vehicle is positioned on opposite sides of the ride path in each swing arc. In the same or other cases, the range of roll angles is 45 degrees clockwise (CW) to 45 degrees (CCW). Alternatively, the range of roll angles is at least 15 degrees (CW) to 15 degrees (CCW) and, in some cases, could be as big as 90 degrees CW to 90 degrees CCW. To provide the swinging sensation, the vehicle is spaced apart from the track some predefined distance, and this may be achieved with a pendulum arm having a length as measured between the first and second ends that is at least 6 feet (e.g., in the range of 6 to 30 feet with some implementations using arms that are 8 to 15 feet long with a 10 foot arm used in some preferred cases). In some implementations, the ride track is flat and is free of banked corners (such that the roll angle of the pendulum arm is wholly independent of any bank angle). To provide a roll DOF for the vehicle, the roll axis is parallel to a longitudinal axis of the ride track.

In some embodiments of the swing ride apparatus, the drive assembly of the bogie (which may be located on or off board the vehicle bogie) is first operated to move the bogie in a first velocity range and second operated to move the bogie in a second velocity range less than the first velocity range. Then, the roll driver is first operated to rotate the pendulum arm through a first roll angle range concurrently with the first operating of the drive assembly and is second operated, concurrently with the second operating of the drive assembly, to rotate the pendulum arm through a second roll angle range that is greater than the first roll angle range. In this way, operations of the various driven bogie and the powered pendulum arm are synchronized to achieve a more natural swing, e.g., one in which greatest translation motion occurs when the pendulum arm is at smaller roll angles and one in which the bogie may travel at its slowest when the pendulum arm is at larger roll angles (e.g., toward the tops of each swing arc the vehicle may move slowly forward and the roll driver may pause or almost pause before moving much more quickly downward into the bottom of each arc located below the ride track).

DETAILED DESCRIPTION

Figure 1:
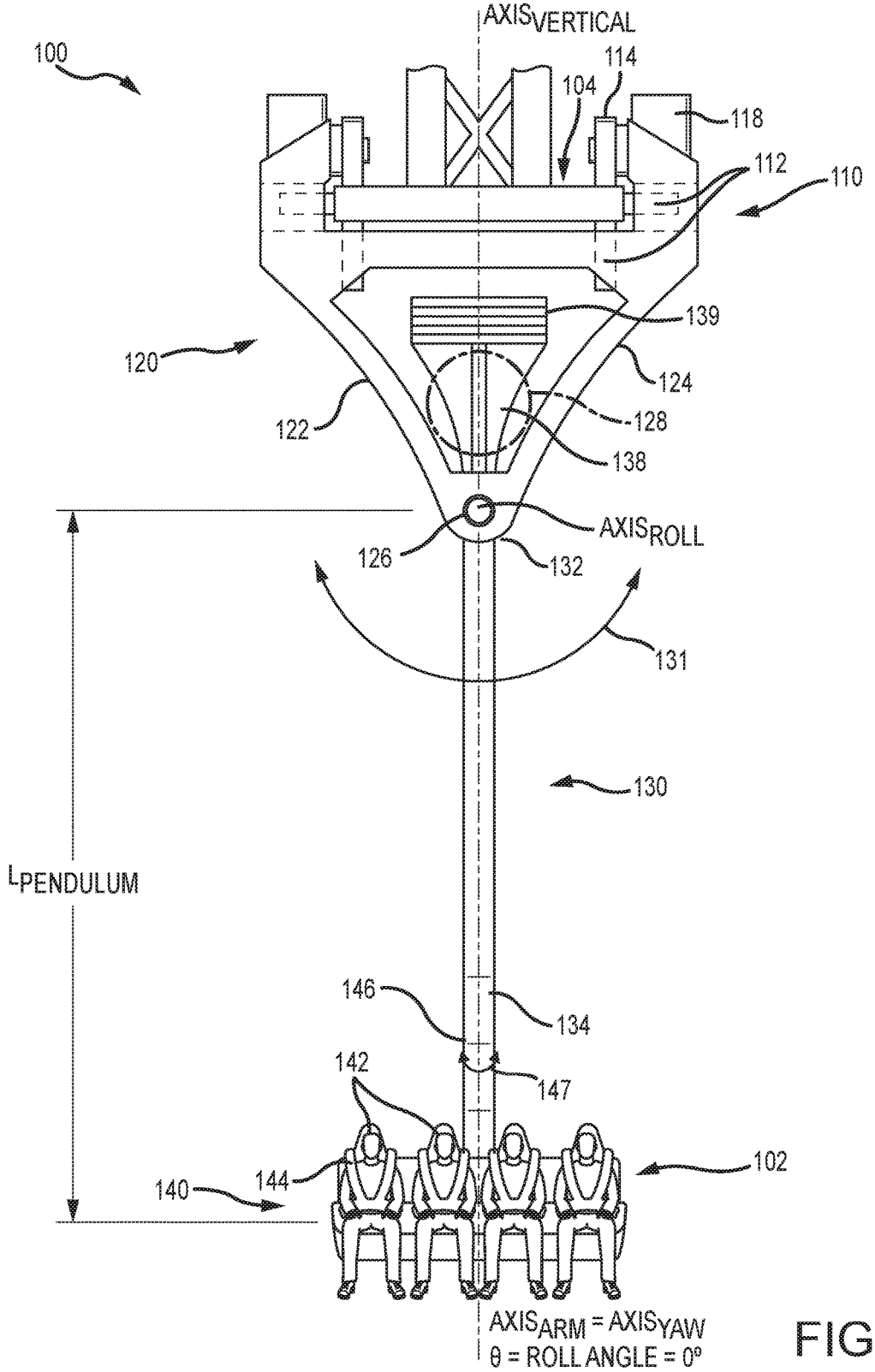
FIG. 1 illustrates a front view of a track-based swing ride system of the present description with the pendulum arm hanging straight down from the supporting track (e.g., with a roll angle of zero degrees as measured between the longitudinal axis of the arm and vertical (or a vertical axis passing through the center of the track in this system configuration)

Briefly, the following description is directed to an amusement park ride (herein "a track-based swing ride system" or "ride system") that makes use of a combination of a powered bogie traveling along a horizontal or flat track (e.g., banks not needed to get swinging effect but could be provided if desired) with a long pendulum arm supporting a passenger vehicle and being powered to rotate about its pivot axis that coincides with a roll axis for passenger vehicle.

In this manner, the passenger vehicle is caused to travel in a direction of travel (DOT) along the ride path defined by the track in a ride space. Further and concurrently, the passenger vehicle is moved through a plurality of roll angles (measured relative to vertical) with clockwise (CW) and counterclockwise (CCW) rotation of the pendulum arm by a drive mechanism (or "roll driver" such as one or more motors, actuators, or the like). The side-to-side movement is carefully controlled to provide a desired swing sensation, e.g., pause or near zero roll velocity at the tops of swings and greatest/greater roll velocity at the bottoms of swings. The swinging may also be synchronized with the speed or velocity of the bogie along the track, e.g., with the bogie moving more slowly when the pendulum arm is at greater roll angles (at the top of a swing) and with the bogie moving more quickly when the pendulum arm is in smaller roll angle ranges (e.g., hanging straight down from the track or in a smaller roll angle such as less than about 15 degrees CW or CCW roll).

Prior to turning to particular implementations that can be used in a ride system, it may be useful to first describe the track-based swing ride system more generally along with design criteria used by the inventor and advantages provided by such a ride system. One goal in designing the ride system was to deliver an experience similar to what it would feel like to be with Tarzan or a similar character swinging between trees of a jungle on a vine or with Spider-Man or a similar character swinging on webs between buildings as you move down streets of a city. It is intended by the inventors that the swinging sensation be provided while also having forward travel along a ride path in a DOT and for the swinging sensation to feel thrilling and fun (e.g., family thrill in some cases). Also, it was desired that the roll or side-to-side swing feel natural (or not forced unless part of the ride program such as a quick direction change in the ride path) like being on a conventional physical swing set of a playground. In this regard, it typically is desirable for the swing sensation to not be restrained or braked (at least in feel to the passenger in the pendulum arm-supported vehicle).

The ride system often will be provided with a theme and show features and elements may be provided to further enhance the swinging sensation provided by the ride system. For example, a show with physical sets and backgrounds and with projected video and lighting effects may be located to the sides and below the vehicle as it travels along the ride path and swings side-to-side relative to the track and the DOT in the ride system. These show elements and features (e.g., projected environments) may be used to provide some forced perspective to make the passengers feel higher above the ground or floor than they really are in the vehicle. The ride system may also include a few "near miss" moments as the vehicle and its passengers swing closely past show elements (e.g., physical sets or projected objects/characters). The ride system may also be configured so as to minimize the view and/or perception by the passengers of the support structure including the track, the pendulum arm (e.g., vehicle may be mounted forward of the supporting end of the pendulum arm), and so on.

With regard to ride system performance, control hardware and software (e.g., a ride controller running a ride program and the like) would be provided in the ride system to provide tight coordination and/or synchronization of all vehicle motion (forward movement at desired vehicle velocities along the track and in the DOT and also side-to-side swinging of the vehicle on the pendulum arm). This is desirable so as to get a desired ride experience such as natural feeling swing that is faster at the bottoms of the swings (in lower roll angle ranges) and slower at the tops of the swings (in greater roll angle ranges both for CW and CCW roll angles). In some cases, the vehicle (or passenger seats) is mounted and powered to yaw during roll and/or forward travel such as to yaw slightly (e.g., a yaw angle of 0 to 15 degrees or the like) inward as roll angle increases.

As noted above, the bogie is configured to roll upon and be supported by the track, and a bogie drive assembly is included to power its movements along the track (along the ride path) in a DOT and with a variable speed (e.g., continuous but with greater bogie (and, therefore, passenger vehicle) velocities when the roll angle is smaller (e.g., in a range of 15 degrees CW to 15 degrees CCW or the like) and lower bogie velocities when the roll angle is greater (e.g., at the "tops" of each swing in both the CW and CCW direction). The drive system providing forward motion of the vehicle could also be accomplished by a track-based propulsion system that includes LSMs, LIMs, or track-mounted pacers that impart forces to a vehicle rolling along the track. The track typically will be flat such as in a horizontal plane with no banks on curves such that the roll angle provided in the ride system is wholly independent of a track bank angle as was case for conventional roller coasters with vehicles supported for free rolling behavior, but, in some cases, the ride system may include a banked track that changes elevation.

The ride system may be built upon a suspended, powered-coaster base that is modified to include a substantially long pendulum arm (e.g., an arm that is 3 to 30 feet in length as measured from its pivot axis, which coincides with the roll axis of the passenger vehicle in this ride system). The pendulum arm extends downward from the track-based drive bogie to a passenger or ride vehicle (which may take nearly any form that includes one or more passenger seats/supports), which would, thus, be supported at a distance of 6 to 20 feet or the like below the track. The pendulum arm has an actuated rotation degree-of-freedom (DOF) on the roll axis (with reference to the passengers in the vehicle). The roll motion is tightly coordinated with the translational motion of the vehicle in order to give the sense of forward swinging (even though only side-to-side swinging is provided on the pendulum arm). The ride system may also be designed to provide additional DOFs such as pitch and/or yaw at the vehicle to enhance the feeling of free and unconstrained swinging.

The new ride system provides coordinated motion between forward speed of the ride vehicle and the roll angle (as measured between the longitudinal axis of the pendulum arm and vertical). This allows the ride program used or run by a ride controller to be written and/or configured so as to achieve a completely new and unique sensation of swinging on a web or vine as the ride system moves passengers through a show provided in the ride space along the track (with the show including physical sets, projection, or a combination of both). This provides a number of advantages over prior swing rides. Swinging suspended coasters have seats located very close to the track that are not actuated or synchronized with forward speed to achieve such a desired swinging sensation, and such rides typically have roll angles that are wholly dependent on track bank angle and lateral forces generated by track turns. Swing-out flat rides are round rides that do not have vehicles moving along a track as the entire structure simply spins in circles. They also typically only swing in one direction relative to their support structure (e.g., CW or CCW), and the roll motion is not synchronized with forward speed to achieve the swinging sensation achievable with the ride system taught herein. Other swing rides may be thought of as "flat rides" that also do not move along a track and rotate passengers in the pitch DOF not in the roll DOF.

Figure 2:
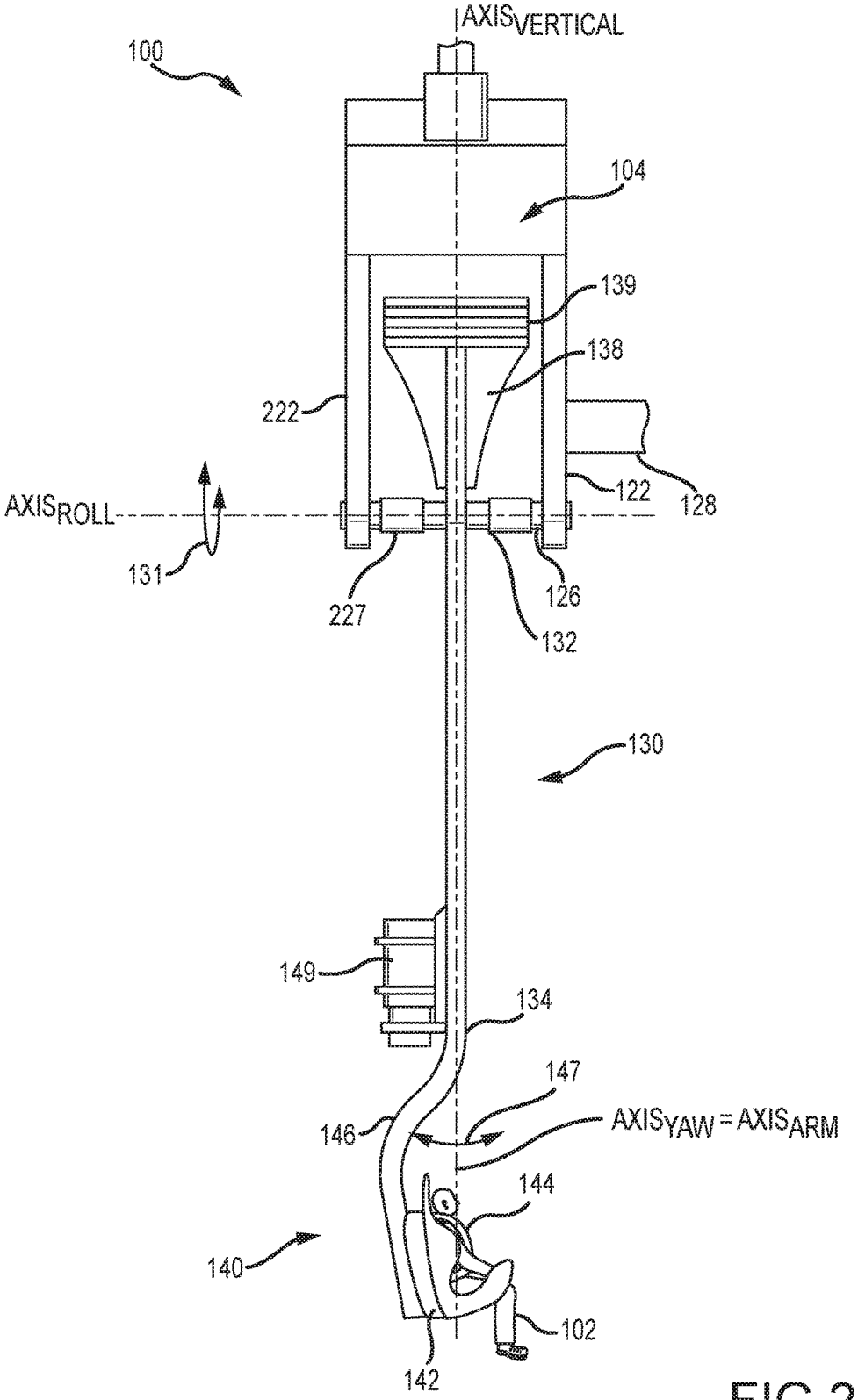
FIG. 2 illustrates a side view of the ride system of FIG. 1.

FIGS. 1 and 2 illustrate front and side views, respectively, of an exemplary track-based swing ride system 100 of the present description. As shown, the ride system 100 includes a track 104 that may be flat or in a horizontal plane (e.g., typically without banks on curves although these could optionally be included) and supported from a ceiling or upper frame structure (not shown) above a ride space, which may include a set providing a physical backdrop for the ride system and/or for projecting video or still imagery to enhance the ride experience for a group of passengers 102.

The ride system 100 also includes a driven bogie 110 with a set of passive rollers/wheels 112 coupling the bogie 110 to the track to roll along its length in a direction of travel (DOT), with the track 104 defining a ride path for the ride system 100. Note, one bogie 110 (and pendulum 130 and vehicle 140) is shown in system 100, but most ride systems 100 would include a plurality of these components that would be dispatched in a spaced apart manner from a loading station of the ride system 100. The bogie 110 is driven to have a desired velocity along the DOT and ride path defined by the track 104. To this end, the bogie 110 includes a pair of drive mechanisms 118 each driving one or more drive wheels 114 that contact, in this example, an upper surface of the track 104 such that rotation of the wheels 114 moves the bogie 110 along the track at desired speeds.

Significantly, the ride system 100 further includes a pendulum arm 130 pivotally supported by or coupled with the driven bogie 110 via a pendulum support assembly 120. As shown, the pivot support assembly 120 includes arms or struts 122, 124, 222 affixed (or rigidly attached) at an upper end to the bogie 110. At the lower end of the struts 122, 124, 222 an upper end 132 of the pendulum arm 130 is pivotally supported via a rotation axle or pin member 126 extending across a space between struts 122, 124 and 222. The pendulum arm 130 further may optionally include upper extension 138 upon which a counterweight 139 can be attached to assist in achieving a desired pendulum motion or rotation back and forth in a CW and CCW direction about the pivotal support provided by axle/pin 126. For example, the counterweight 139 may be sized (or weighted) such that about an equal amount of weight is provided on either side of the axle 126 and roll axis, $Axis_{Roll}$, (e.g., with a counterweight 139 and extension 138 weighing about the same amount as the arm 130 and vehicle 140 (with an average weight of passengers 102)).

More specifically, the pendulum arm 130 is mounted at upper (or first) end 132 via axle 126 to rotate as shown with arrow 131 about a roll axis, $Axis_{Roll}$, extending along the longitudinal axis of the axle 126. The roll axis, $Axis_{Roll}$, in the system 100 is provided to be parallel to the longitudinal axis of the track 104 as well as to the DOT of the bogie 110. The rotation or roll 131 is powered or driven, and, in this regard, the ride system 100 further includes a roll driver 128, which may be an electric motor, an actuator, or other device operable (e.g., in response to control signals) to pivot 131 the pendulum arm 130 on the axle/pin 126 about the roll axis, $Axis_{Roll}$. Such driving of the arm 130 by the roll driver 128 is used to define a roll angle, θ, for the ride system 100 as may be measured between the longitudinal axis, $Axis_{Arm}$, of the pendulum arm 130 and vertical, $Axis_{Vertical}$ (which may extend orthogonally through the center of the track 104 in this example). In the operating state shown in FIGS. 1 and 2, the roll angle, θ, is zero degrees, which can be used for loading and unloading and, more interestingly, also corresponds with the bottom of a swing or swing arc of the pendulum arm 130.

As discussed below, the driving of the bogie 110 with the bogie drive mechanism 118 and the rotating/pivoting 131 of the pendulum arm 130 are closely synchronized or coordinated to achieve the desired ride experience. This typically includes driving the bogie 110 in its faster velocity ranges when the pendulum arm 130 is in a relatively small roll angle range (e.g., θ is 15 degrees CW to 15 degrees CCW). For example, the bogie 110 may be driven at its maximum velocity along the track 104 in the DOT when the roll angle, θ, is zero degrees as shown in FIGS. 1 and 2.

To achieve a natural swing sensation, the roll driver 128 may likewise be controlled to cause the roll velocity (or speed of rotation/pivoting/rolling 131 about the roll axis, $Axis_{Roll}$) to be synchronized with the roll angle, θ. For example, the roll velocity of the pendulum arm 130 may be in a maximum or higher range when the roll angle, θ, is in the relatively small roll angle range while being in a minimum or lower range (or even halting/pausing roll for a brief time period) when the roll angle, θ, is in a relative larger roll angle range (or when at the top of each swing or near the top (e.g., within 10 to 20 percent of the maximum roll angle, θ, of each swing arc as the bogie 110 moves along the track 104 under power by drive mechanism 118)).

The ride system 100 further includes a passenger vehicle 140 with a number (e.g., 1 to 8 or more) vehicle seats or passenger supports 142 for receiving a like number of the passengers 102. Passenger restraints 144 are included in the vehicle 140 to restrain each passenger 102 in their seat 142. A wide variety of vehicle and seating designs may be used to practice the ride system 100, with the exemplary seats 142 with dangling passenger feet and over-the-shoulder restraints 144 just being one useful example for implementing the ride system 100. The passenger vehicle 140 is generally supported at a lower (or second) end 134 of the pendulum arm 130 (e.g., distal to the pivotal coupling via axle 126 at the upper (or first) end of the pendulum arm 130). In this example, the vehicle 140 includes a support arm or extension arm 146 rotatably coupled to the lower end 134 of the pendulum arm 130 (or this extension element 146 may be considered part of the pendulum arm 130).

The vehicle 140 (or the seats 142) is supported at a significant distance, such as 6 to 30 feet or more (with 10 to 20 being used in some ride designs), from the pivotal coupling with axle 126 and the roll axis, $Axis_{Roll}$. To achieve this distance, the pendulum arm (in this case including the extension arm/element 146) may have a length, $L_{Pendulum}$, in the range of 6 to 30 feet, and this length, $L_{Pendulum}$, is relatively large as it is likely that this greater separation of the vehicle 140 from the supporting track 104 is useful in achieving the side-to-side (and forward with vehicle velocity along the track 104) swinging sensation provided during operation of the ride system 100.

The rotatable coupling allows a drive mechanism (e.g., a motor) 149 which may be included in the system 110 for selective operation, to move the vehicle 140 as shown with arrow 147 about the yaw axis, $Axis_{Yaw}$, of the vehicle 140. For example, it may be desirable to yaw or twist 147 the vehicle inward as the pendulum arm 130 is rotated through or into its larger roll angle ranges or toward the top of a swing or swing arc to achieve a desired swing sensation for the passengers 102 in the seats 142 of the passenger vehicle 140 as though they are rotating to face the ground before the next swing. The amount of yawing 147 may be relatively small such as 3 to 15 degrees or the like in many applications. Although not shown in FIGS. 1 and 2, the vehicle 140 may further be coupled with the pendulum arm 130 to be moved with addition DOFs such as with yaw to achieve a desired ride experience while providing roll with rotation 131 of the pendulum arm 130 with the roll driver 128.

By supporting a vehicle 140 at the end of a pivotal pendulum arm 130, the ride system 100 allows the vehicle 140 to be swung back and forth as the bogie 110 and interconnected vehicle 140 also travel in a continuous manner along the ride path defined by the track 104. FIGS. 1 and 2 show the ride system 100 when the pendulum arm 130 and the vehicle 140 are not being swung at all or when at the bottom of an active swing or swing arc (e.g., from a CCW high point or a maximum CCW roll angle to a CW high point or a maximum CW roll angle for a particular swing or swing arc). The swinging may be controlled by operation of the roll driver 128 to simulate a desired natural swinging motion. This may involve for example smaller swing arcs initially during travel and then building to larger and larger swing arcs and corresponding roll angles. In other cases, the pendulum arm 130 may be held in a horizontal position (such as while loading of passengers 102 into the vehicle 140), and then be "dropped" off a horizontal support through a quite large swing arc (e.g., start at a roll angle of 90 degrees CW and roll quickly to the bottom of the swing arc to a roll angle of 90 degrees CCW (or a range of 80 to 110 degrees CCW or other desired range).

Figure 3:
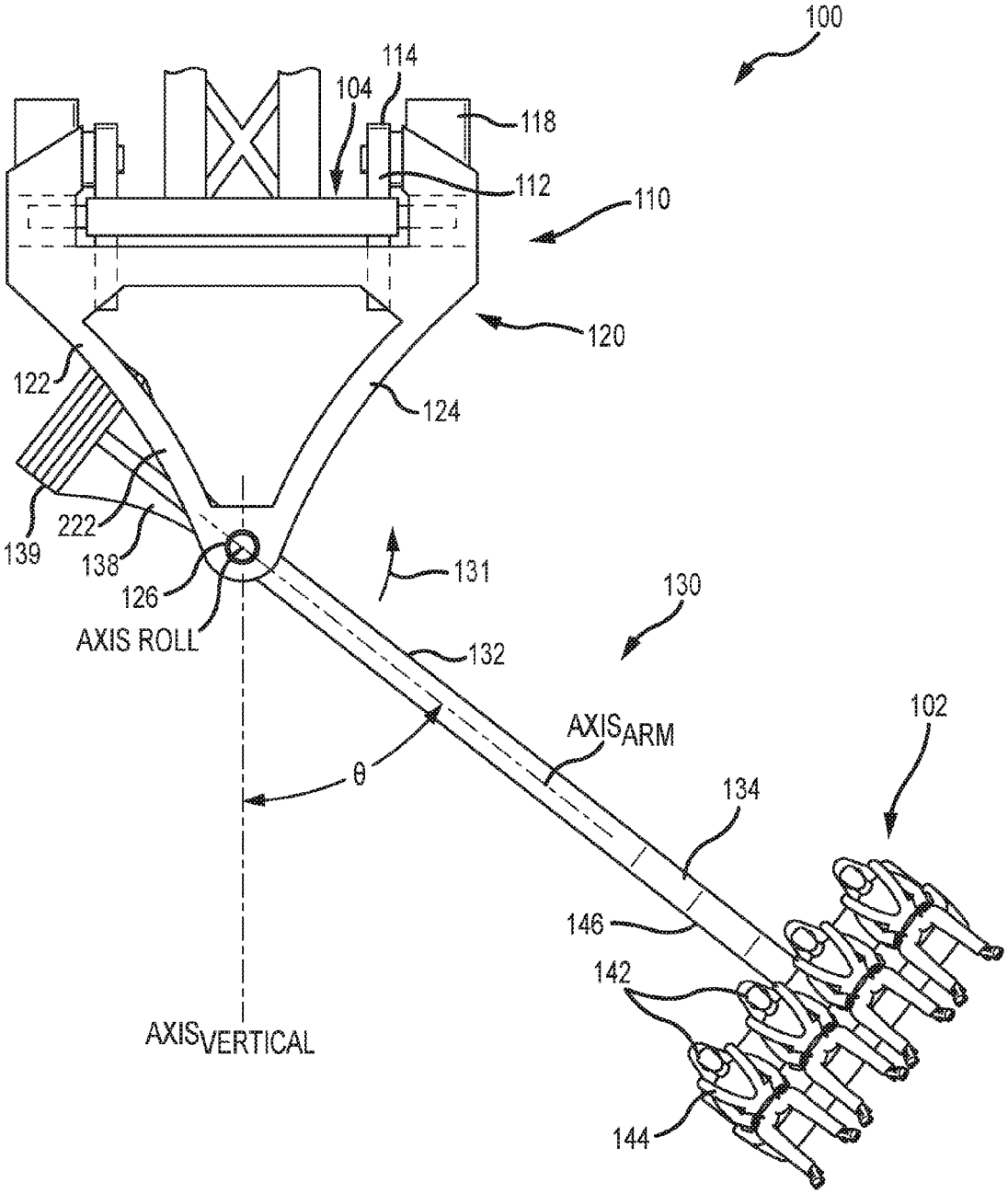
FIGS. 3 and 4 illustrate rotation of the pendulum arm and supported vehicle during operations of the ride system of FIGS. 1 and 2 by showing in FIG. 3 rotation in the CCW direction to a first roll angle and by showing in FIG. 4 rotation in the CW direction to a second roll angle.

With these operations in mind, FIG. 3 illustrates the ride system 100 of FIGS. 1 and 2 during a roll operation to provide a desired swing. Typically, the ride system 100 in FIG. 3 would also be operating the bogie drive mechanisms 118 to rotate the drive wheels 114 to move the bogie 110 and interconnected pendulum arm 130 and passenger vehicle 140 at a velocity (bogie or vehicle speed or velocity) along the track 104, with the velocity being synchronized with the roll operation as discussed above. As shown, the roll driver 128 has operated so as to pivot or rotate 131 the pendulum arm 130 through a CW roll angle, θ, which causes the passenger vehicle 140 and passengers 102 to be swung outward from the track 104 and ride path and up to a height above the vertical position shown in FIGS. 1 and 2. The vehicle 140 would have a roll velocity at this roll angle, θ, that would be set by the roll driver 128 depending upon whether this is at or near the maximum roll angle, θ, for this swing or swing arc or an intermediate point. If at or near the maximum roll angle, θ, the roll velocity may be relatively low or may even be at or near zero to provide a pause as the arm 130 is decelerated toward the top of side of the swing arc in some embodiments to simulate a more natural swing. If at an intermediate point between the high and low points in the swing arc, the roll velocity may be controlled by the roll driver 128 to be at some value between the maximum roll velocity for this swing (provided at or near the bottom of the swing arc at or near a roll angle, θ, of zero degrees) or swing arc and the minimum roll velocity provided at or near the tops of the swing or swing arc. In this example, the roll angle, θ, is about 45 degrees CW.

Figure 4:
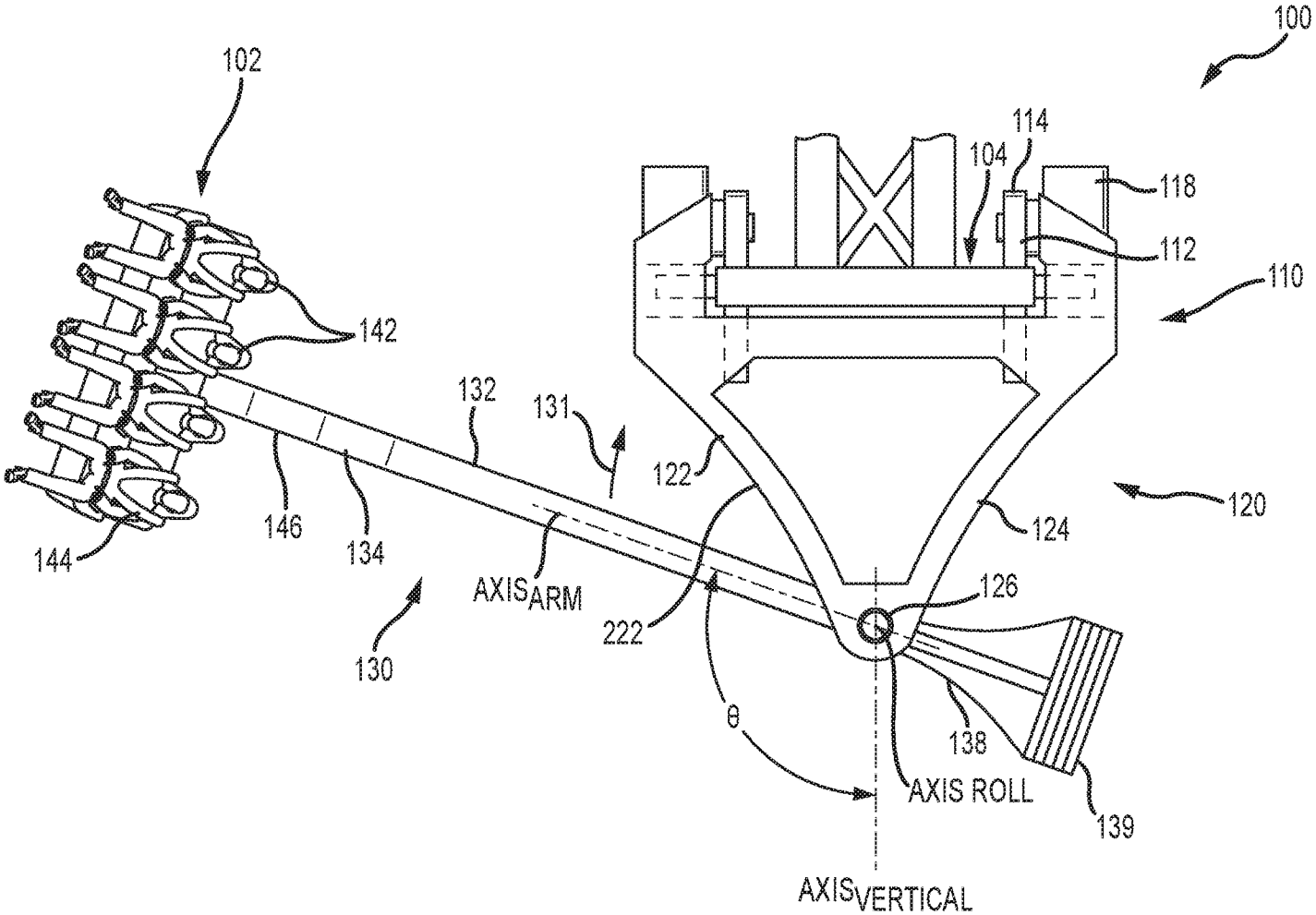

FIG. 4 illustrates the ride system 100 at a different point in its operations. Particularly, the roll driver 128 has been operated to drive or pivot 131 the pendulum arm 130 and supported vehicle 140 with roll to a new roll angle, θ. As shown, the roll angle, θ, is about 105 degrees CCW. In some cases, this amount of roll 131 may place the pendulum arm 130 at a top of a swing arc at this particular location on the ride path defined by the track 104. In that case, the roll velocity imparted or limited by the roll driver 128 may be in a lower velocity range or even be at zero (which may be held for a small period of time) to provide a natural swing feel of pausing at the top of a swing arc.

Also, in this operating example, the bogie drive mechanisms 118 may be operated to slow the bogie 110 (and interconnected vehicle 140) into a relatively slow velocity range as it is sometimes useful to have the vehicle's translational motion synchronized with the rotational movement through roll so as to move more quickly with smaller roll angles and less quickly at the larger roll angles of each swing or each swing arc (e.g., the top roll angle may be 15 degrees in one swing arc and 45 degrees in another and 90 degrees or more in another and, in each case, the bogie drive mechanisms 118 may be controlled to slow down at or near the top of each swing arc). When larger amounts of roll (larger roll angles, θ) are provided, the yaw driver 149 may concurrently be operated to rotate the vehicle 140 about the yaw axis, $Axis_{Yaw}$, such as to provide some amount (e.g., 1 to 15 degrees) of inward yaw to the vehicle 140 to provide a more natural swing feel.

Figure 5:
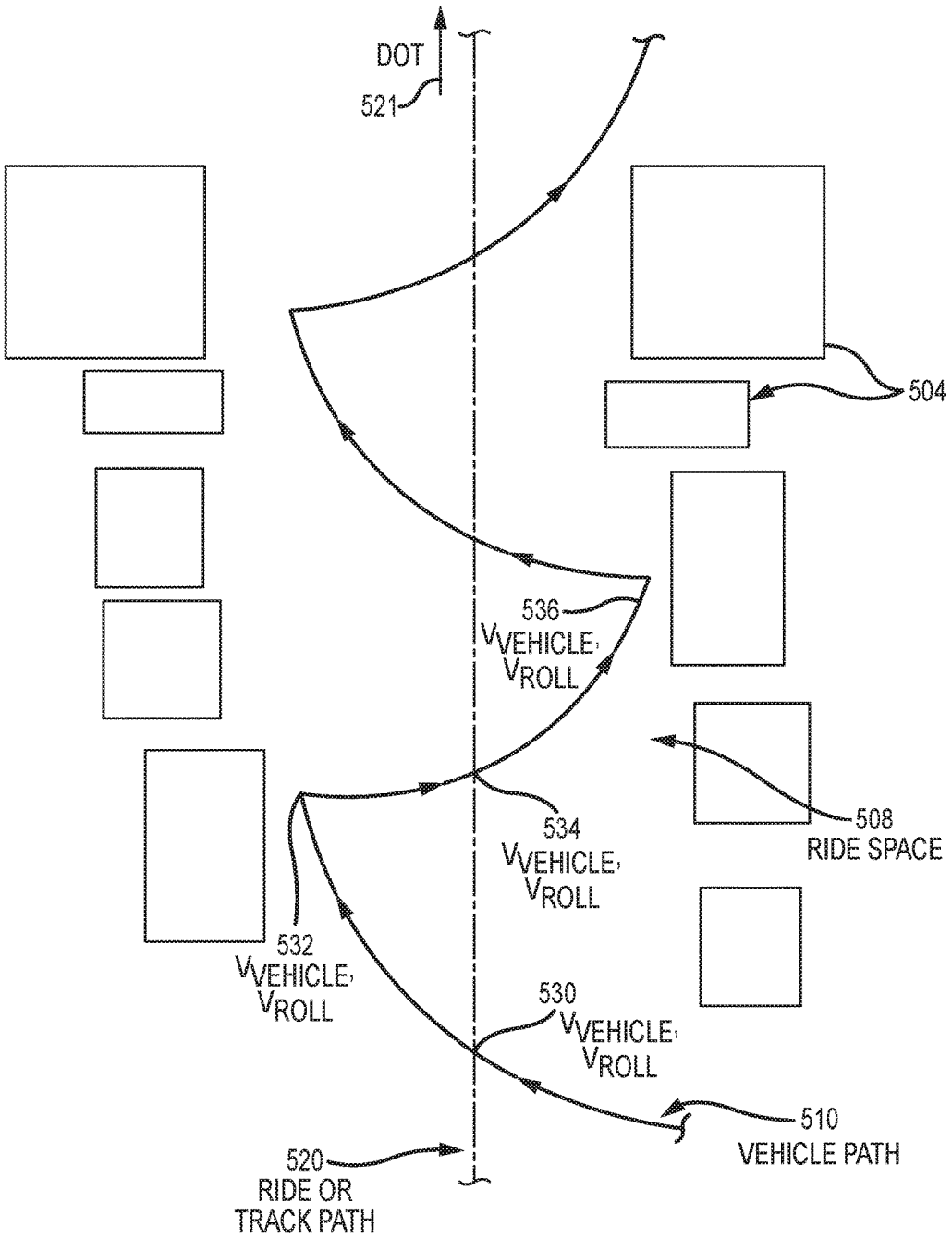
FIG. 5 is a schematic drawing showing a plan view of an amusement park ride using a ride system of the present description to provide a swinging sensation to passengers in a vehicle suspended from a track on a pendulum arm.

FIG. 5 illustrates a plan schematic view of a ride system implementing the concepts of a vehicle with translational movement along with side-to-side swing. As shown, the ride system includes a set (e.g., simulating a jungle, a city, or other show set) providing a dimensional environment including a volumetric ride space 508. A track (not shown) is used in the ride system to define a ride or track path 520 through the ride space 508, with the simple example of FIG. 5 being a straight line through the space 508 between the pieces/portions of the physical set 504 (upon which virtual set features may be provided by projection or other special effects). As shown with the ride system 100 of FIGS. 1-4, the ride system of FIG. 5 may include a track-based bogie that is driven on the track so as to have translational movement along a DOT as shown with arrow 521. The velocity of the passenger vehicle, $V_{Vehicle}$, is provided by powering this bogie and then suspending the passenger vehicle below this moving bogie at the end of an elongated pendulum arm.

A ride system is a swing ride because the pendulum is powered by a roll driver (as discussed, for example, with reference to FIGS. 1-4) so as to pivot about a roll axis passing through its coupling point with the bogie (or a pendulum support assembly affixed to the lower portions/surfaces of the bogie). Due to this swinging, the vehicle path 510 (a tracing of the position/location of the passenger vehicle on the lower end of the pendulum arm) as shown in FIG. 5 does not simply follow the ride path 520 but, instead, moves in an oscillating manner back and forth across the ride path followed by the track-based and driven bogie. In other words, the vehicle path 510 during each swing or swing arc is transverse to the ride path 520 (or the DOT 521) followed by the driven bogie.

As shown, the vehicle path 510 starts to the right of the ride path 520 and crosses over the ride path at a point/location 530 (e.g., a first 3D coordinate in the ride space 508) prior to reaching an upper point or top of this first swing or swing arc at a point or location 532 (e.g., a second 3D coordinate in the ride space 508). This corresponds to a maximum roll angle for the pendulum arm that places the vehicle in the location 532. Then, a new swing or swing arc begins as the pendulum arm swings back down or through a CCW rotation to cross over ride path 520 again at a point/location 534. The pendulum arm continues to rotate CCW through a range of roll angles until the vehicle is in position/location 536 of the ride path (or at an upper point/location in this swing or swing arc that began at location/position 532). Such back and forth swinging continues as the vehicle follows the vehicle path 510, and, as can be seen, forward translation motion along the DOT 521 is achieved during each swing or swing arc because the bogie from which the pendulum arm and vehicle are suspended continues to move along the ride or track path 520.

As discussed with reference to the ride system 100 of FIGS. 1-4, it may be desirable for the driving of the bogie to be coordinated or synchronized with the driving of the pendulum arm through a range of roll angles (or rotation about the roll axis). In other cases, though, a ride designer can configure the motion profile to disconnect such synchronization to achieve a particular ride experience, e.g., to quickly brake a swinging motion to avoid a collision or to quickly accelerate a pendulum arm's rotation to cause the vehicle to quickly move to the left or right (to follow or avoid a physical or virtual set object).

When natural swinging is desired, for example, synchronization of the bogie drive assembly and the roll driver (e.g., one or more motors used to rotate the pendulum arm about the roll axis) may be used (e.g., through configuration of a ride program run by a ride controller generating control signals for the ride system's drive devices). As shown, this may involve controlling the bogie (and, hence, suspended vehicle) to move in a relative high range of velocities, $V_{Vehicle}$, at locations 530 and 534 when the pendulum arm is at a zero (or small) roll angle and the vehicle is hanging straight down (or nearly so) below the track. The roll driver may concurrently be operating to drive the pendulum arm to move at a roll velocity, $V_{Roll}$, that is in a higher range for the particular swing or swing arc. Often, both of these velocities, $V_{Vehicle}$ and $V_{Roll}$, will be greater for larger swings or swing arcs when compared with smaller swings or swing arcs. For example, it may feel more natural to have greater translational or forward movement along the ride path 520 in the DOT 521 in a larger swing (such as a CW roll angle of 90 degrees to a CCW roll angle of 90 degrees) than in a smaller swing (such as CW roll angle of 15 degrees to a CCW roll angle of 15 degrees) where lower vehicle velocities and roll velocities, $L_{Pendulum}$, may be chosen by the ride controller.

In contrast, both of the drivers (roll driver and bogie driver) may be operated in a synchronized manner to cause translation motion of the vehicle, $V_{Vehicle}$, to slow and for roll to slow or even stop (e.g., a roll velocity, $V_{Roll}$ of zero or near zero) when the vehicle is at points/locations 532, 536 on the ride path 510, e.g., is at the top of a swing or swing arc at 532 or near such a top at 536. Again, this mimics the motion in a natural swing as motion seems to pause at the top of a swing and speed up significantly as the bottom of the swing arc is approached or reached. The amount of pause or slowing of the roll velocity, $V_{Roll}$, and the decrease in vehicle velocity, $V_{Vehicle}$, at locations 532, 536 may again be chosen based on magnitude or size of the swing (e.g., how great is the roll angle at the tops 532, 536?). For example, the vehicle may not slow as much in a small or low swing and the pause or reduction in roll velocity, $V_{Roll}$, may also not be as great for such a swing or swing arc. However, for a large or high swing (such as over 60 degrees or the like), the translational motion and vehicle velocity, $V_{Vehicle}$, and the degree of roll/arm deceleration may be greater (e.g., $V_{Roll}$ may be reduced and/or paused longer) for such larger swings to match expected sensations in a larger swing.

Figure 6:
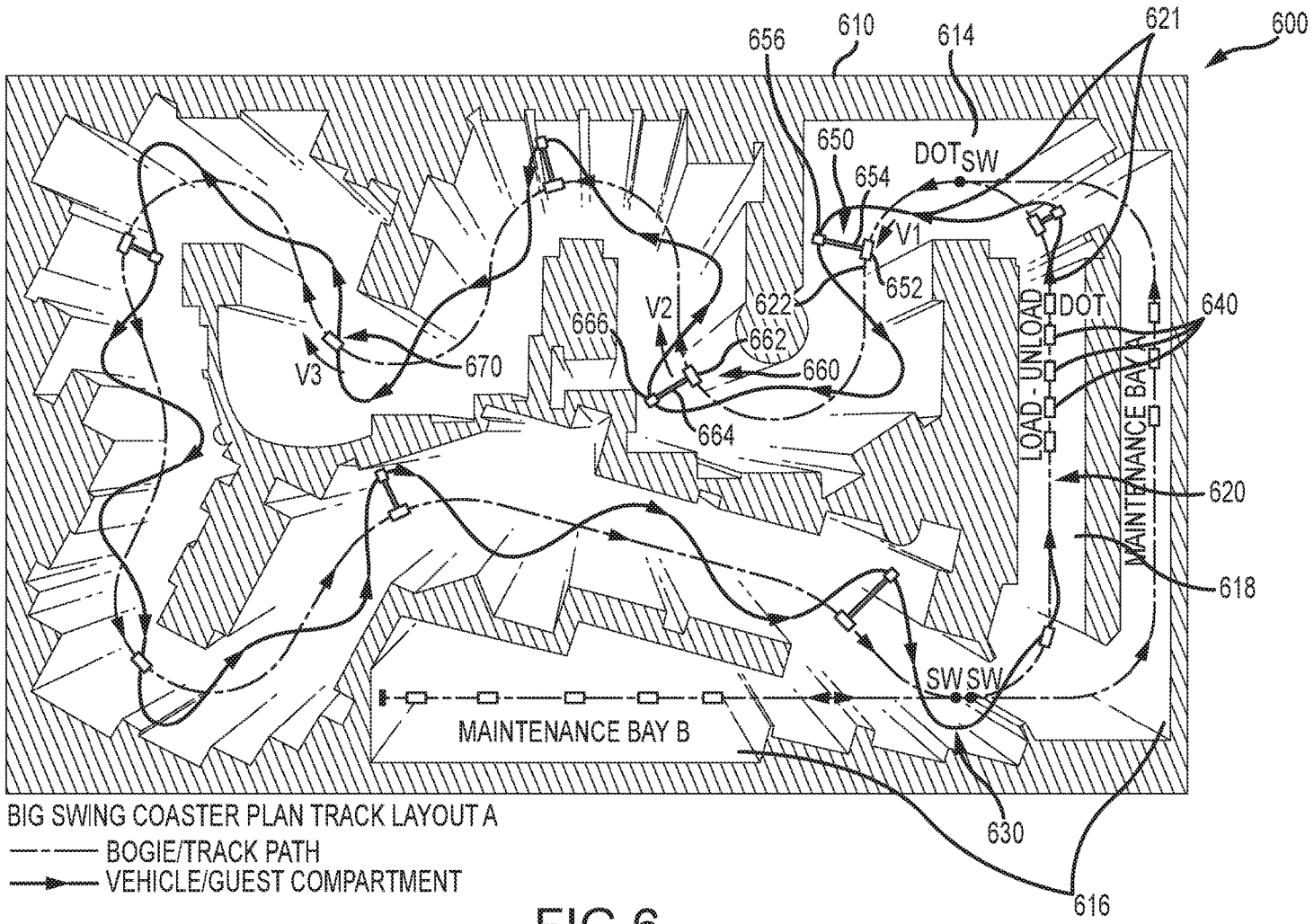
FIG. 6 illustrates a schematic plan view of an amusement park ride with a ride system of the present description showing side-to-side swinging of the pendulum arm and supported vehicle through a ride space with a plurality of curves.

FIG. 6 illustrates a more complex ride system 600 showing how a combination of a powered/driven pendulum and a powered bogie can be used to implement a unique swinging ride experience. As shown, the ride system 600 includes a physical set or prop structure 610 that defines a ride space 614 through which a ride track 620 may be positioned or run in circuitous manner with many bends/curves as well as straightaways. The ride system 600 further may include sections for performing specific non-swing related functions such as a maintenance bay(s) 616 and a loading/unloading zone 618 where a number of vehicle assemblies 640 may be positioned to facilitate passenger loading and unloading.

After loading, each of the vehicle assemblies 640 is moved out of the zone 618 by operation of their bogie drive assembly to follow the ride path defined by the track 621 in a DOT as shown by arrows 621. Vehicle assembly 650 has moved (by bogie drive assembly operation) to a first location 622 on the track 620. The assembly 650 includes a driven bogie 652 that follows the track 620 and its defined ride path and is moving at a first velocity, $V_1$, set by the drive assembly of the bogie 652. The vehicle assembly 650 also includes a passenger vehicle 656 supported at the lower end of a pendulum arm 654, which as shown, has been rotated (by a roll driver supported on the bogie 652) outward in a CCW direction. The track location 622 may correspond with a top of a swing or swing arc (as defined in a motion profile for the vehicle 656 for the ride system 600 and implemented by a ride controller (see, for example, FIG. 8)). As a result, the roll velocity may be paused or in a range of lower roll velocities while concurrently the bogie driver may be operated to slow the bogie 652 into a slower range of vehicle velocities (e.g., to set $V_1$ relatively low) to have less translational movement when the vehicle 656 is swung out on the arm 654 to the top of a swing or swing arc.

Similarly, vehicle assembly 660 has moved along the track 620 to a new location on the ride path. The assembly 660 includes a driven bogie 662, a pendulum arm 664, and supported passenger vehicle 666 at the lower end of the pendulum arm 664. The vehicle 666 is shown to be at a point in the vehicle path 630 that appears to coincide with a top or maximum CCW roll angle of a swing or swing arc (which may be somewhat smaller than being experience by vehicle assembly 650). Hence, the ride controller for system 600 may operate to slow the bogie by operation of the bogie drive assembly to have the vehicle velocity, $V_2$, in a slower range of velocities and to concurrently operate the roll driver so as to slow (or even halt/pause) roll of the pendulum arm 664. In contrast, though, the vehicle assembly 630 has moved into a third location on the vehicle path 630 that coincides with the ride path 620. At this point, the pendulum arm is hanging vertically downward (has a roll angle that is zero or that is relatively small such as less than 15 degrees or the like). Hence, the pendulum arm of vehicle assembly 630 may be moved rapidly (have a higher or highest roll velocity for this particular swing or swing arc) by its roll driver (or allowing to move at such speed if no assist is needed) while concurrently the bogie drive assembly may set a vehicle velocity, $V_3$, that is higher than the velocities, $V_1$ and $V_2$, where the assemblies 650, 660 were in operating states providing larger roll angles.

Figure 7:
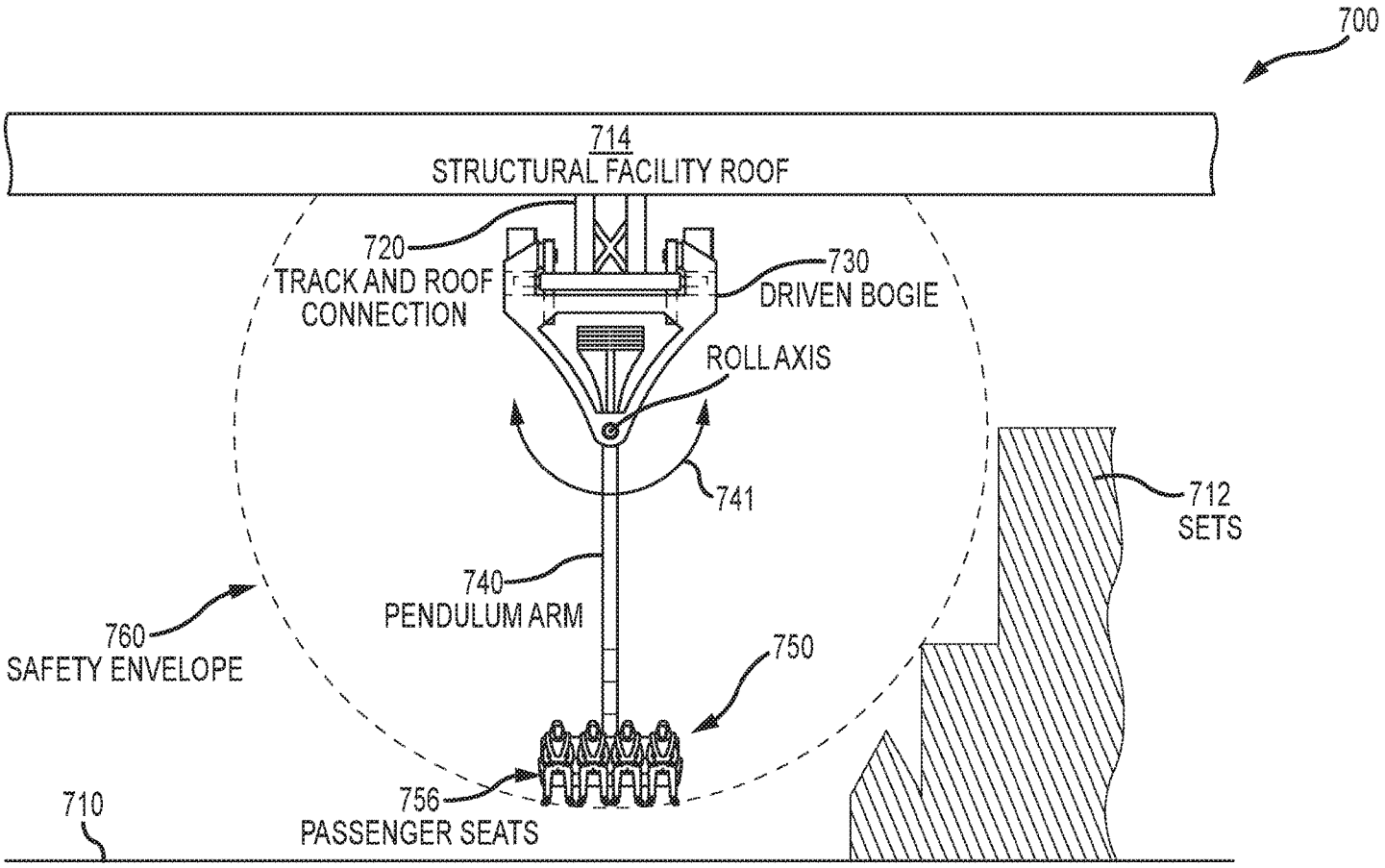
FIG. 7 is a schematic side or profile view of a ride with a ride system of the present description illustrating implementation of a safety envelope for passengers in passenger seats (in seats/supports of a vehicle) during rotation of a pendulum arm supporting the seats about a roll axis.

FIG. 7 provides an elevation view of a ride system 700 of the present description. FIG. 7 shows how vehicles 750 with passengers in seats 756 can be moved safely within a safety envelope 760 so as to avoid any risk of contact with physical sets 712 but still achieving "close call" sensations. As shown, the ride system 700 includes a structural roof or upper frame 714, and a track 720 is attached to and hung below this roof/frame 714. The ride system 700 includes a driven bogie 730 for each vehicle assembly that rides on and is supported by the track 720 and that includes a drive mechanism (e.g., a motor with drive wheels) moving along the ride path defined by the track 720 relative to the set 712 at a bogie and vehicle velocity (which can be synchronized by a ride controller with movement of the pendulum arm 740).

The ride system 700 also includes a pendulum arm 740 pivotally coupled with the driven bogie 730 (such as through a pendulum support assembly not shown in FIG. 7 but seen in FIGS. 1-4), and a roll driver would be included in system 700 to selectively pivot or rotate the pendulum arm 740 back and forth in a swinging motion (first CW and second CCW (or vice versa)) about the roll axis as shown with arrow 741. A vehicle 750 is attached (with or without other DOFs such as pitch and yaw) to the lower (or outer) end of the pendulum arm 740, and one or more (four shown) seats 756 are provided in the vehicle 750 for receiving and restraining passengers during operation of the ride system 700. As shown, the pendulum 740 can be rotated 741 about the roll axis through a larger range of roll angles (e.g., a CCW roll angle of 115 degrees and a CW roll angle of 115 degrees) while a safety envelope 760 can easily be defined based on such rotation (the envelope 760, for example, would be greater than the length of the pendulum arm 740 combined with the size/dimensions of the vehicle 750) to define where the sets 712 can be positioned in the ride space of the system 700.

Figure 8:
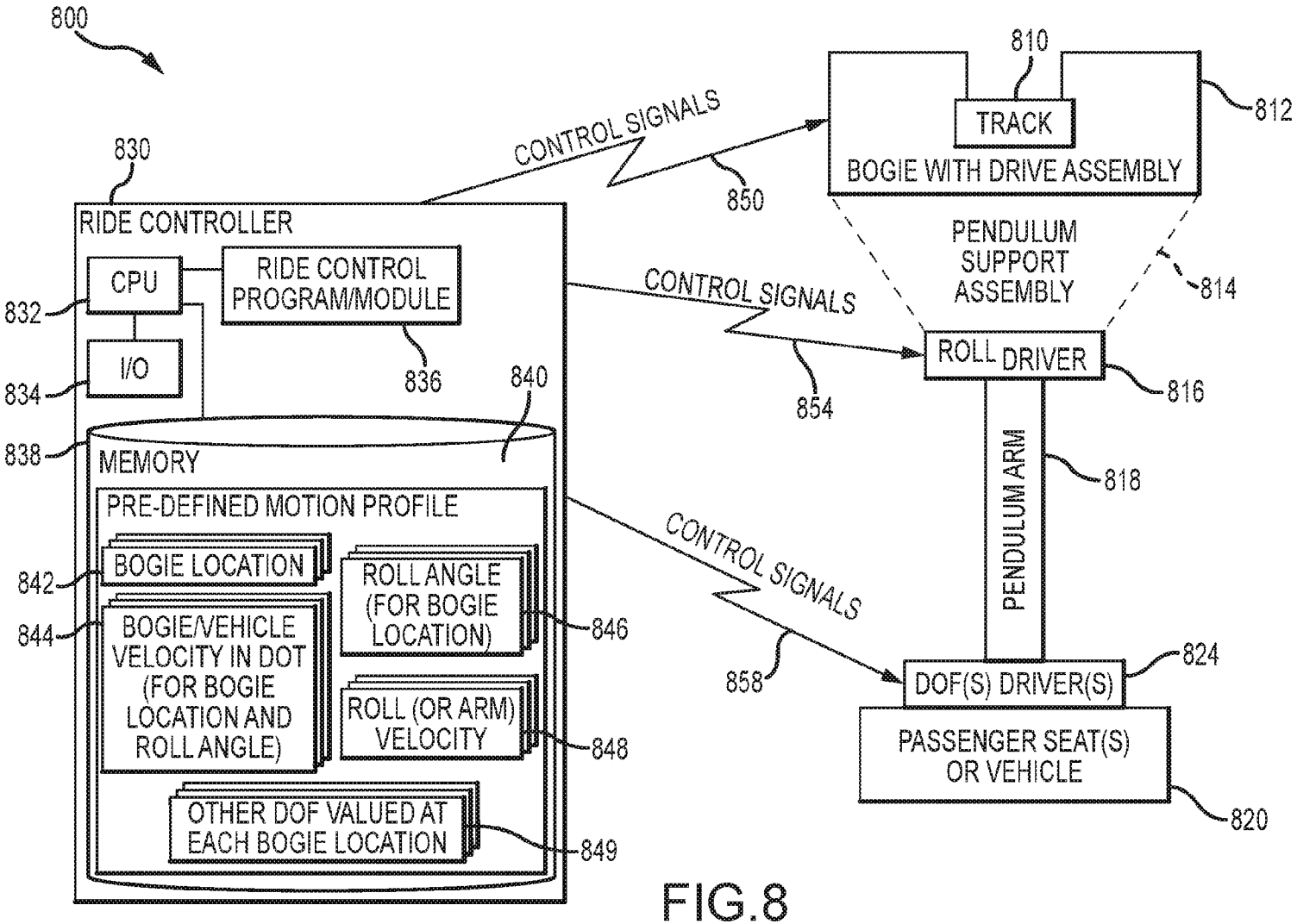
FIG. 8 is a functional block diagram of a ride system of the present description illustrating features and operation of a ride controller to control each vehicle assembly to synchronizing operation of the bogie drive assembly with operation of the pendulum arm's roll driver.

FIG. 8 illustrates a functional block diagram of a track-based swing ride (or ride system) 800 of the present description (such as may be used to implement the ride systems of FIGS. 1-7). The ride system 800 includes a track 810 with a driven bogie 812 rolling in a DOT along the ride path defined (such as with the center longitudinal axis) by the track 810, which may be a flat or non-banked track. The ride system 800 further includes an elongated pendulum arm 818 (e.g., 6 to 30 feet in length in some embodiments) that is suspended below the track 810.

Particularly, the pendulum arm 818 is rotatably coupled to the driven bogie 812 via a pendulum support assembly 814. Selective rotation through a roll axis (not shown but typically extending through an upper end of the pendulum arm 818) is achieved with a roll driver (e.g., an electric motor or actuator or the like) 816. The ride system 800 further includes one or more passenger seats (typically in a passenger vehicle) 820 supported upon a second or lower end of the pendulum arm 818 to be spaced apart from (e.g., by 3 to 20 feet or the like) and/or distal to the track 810. The ride system 800 may also optionally include one or more additional DOF drivers 824 to move the passenger seats/vehicle 820 in DOFs in addition to roll (provided by rotation of pendulum arm 818 with roll driver 816) such as in pitch, yaw, or the like.

The ride system 800 further includes a ride controller 830 that functions to control operations of the drive assembly of the driven bogie 812 (with control signals 850), to control operations of the roll driver 816 (with control signals 854), and any additional DOFs drivers 824 (with control signals 858). The ride controller 830 includes one or more processors 832 that run/manage input and output (I/O) devices 834 that may operate to transmit the control signals 850, 854, 858. The I/O devices 834 may also include input devices such as touchscreens, keyboards, a mouse, voice recognition devices/software, and the like that allow a ride operator (a human operator) to enter data such as to select a ride program with a pre-defined motion profile for each vehicle of the ride system 800 through a ride space on a ride path defined by the track 810 or such as to initiate ride system operations.

The ride controller 830 uses the processor 832 to execute software/executable code or instructions that may be in computer-readable media to provide the ride control program/module 836, which functions to generate the control signals 850, 854, 858 in a synchronized manner (or artistic manner, in some embodiments, to achieve a particular ride experience or passenger sensation) and based on a particular location of the bogie 812 (and suspended vehicle 820) relative to the track 810 (or a ride path defined by such track 810). The ride controller 830 includes memory 838 (or memory devices may be accessible by the controller 830), which is managed by the processor 832 to facilitate functions of the ride control program 836.

Particularly, the memory 838 is used to store a pre-defined motion profile 840 that defines movements and positions of the passenger seats/vehicle 820 at each location along the track 810 or ride path (e.g., the profile defines the vehicle path through the ride space as discussed with reference to FIG. 6). Particularly, the motion profile 840 may define a plurality of bogie locations 842 along the track 810 for which it is desirable to define a specific location of the passenger vehicle 820 and/or other motion parameters, and this information is used by the control program 836 to control operations of the drive assembly of the bogie 812, the roll driver 816 to rotate the arm 813 about the roll axis, and to operate the additional DOFs drivers 824.

Specifically, the ride control program 836 may first determine a location 842 of the bogie 812 along the track 810 (or ride path). For this location 842, the motion profile 840 may define a vehicle velocity in the DOT, and this coincides with the velocity of the bogie 812 such that the control program 836 generates control signals 850 to operate the drive assembly of the bogie 812 to drive the bogie 812 at this velocity 844. This velocity 844 is, in some motion profiles 840, synchronized with or adjusted to suit a roll angle 846 that is also defined by the motion profile 840 for the particular bogie location 842. Hence, the ride control program 836 is configured to concurrently generate control signals 854 to the roll driver 816 to operate to achieve a desired roll angle for this location 842.

As discussed above, the vehicle velocity may be set to be greater with smaller roll angles and to be less with greater roll angles (or at or near the top of each swing arc for the pendulum arm 818 and vehicle 820 being performed at each bogie location 842 along the track 810). Further, the roll (or arm) velocity 848 is also defined by the motion profile for each bogie location 842 and roll angle 846 (and point in a swing arc or swing being performed), and, with this information/definition 848, the ride control program 836 generates the control signals 854 to operate the roll driver 816 to rotate the pendulum arm 818 at a rate (roll velocity) matched or synchronized to the roll angle 846 (within a swing arc or swing cycle), e.g., to have a rapid arm movement at smaller roll angles (such as when hanging straight down from the bogie 812 with zero or near zero roll angles), to have slow arm movement at larger roll angles for each arc, and to have an intermediate arm movement/roll velocity between these two roll angles for each swing arc.

In embodiments where additional DOFs drivers 824 are provided, the motion profile 840 also includes definitions for other DOFs values 849 at each bogie location 842 along the track 810, and the ride control program 836 functions to generate the control signals 858 to operate the drivers 824 to provide the motions of the passenger seats/vehicle 820 provided in these definitions 849. For example, inward yaw of the seats/vehicle 820 may be provided by a driver 824 when the roll angle is relatively large (e.g., start yaw movement once the roll angle exceeds a predefined value such as 45 degrees and increase the yaw with increasing roll angle values) or at the top of each swing arc to enhance the swing sensation.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

From the above description, it should be readily be understood that the inventors have created a track-based swing ride system that is new and unique when compared with prior rides. The ride system includes a powered or driven bogie system that rides on an elevated track structure. Attached to and extending below the driven bogie system is a significantly elongated structural pendulum arm with a passenger/rider compartment or set of passenger seats/supports (one or more ride vehicles) attached to the opposite end of the pendulum arm.

The pendulum arm is rotationally connected to the driven bogie system and can be rotated and precisely controlled in its movements about its rotation axis (the roll axis) in either (and both) CW and CCW direction. This rotation of the pendulum arm moves the passenger compartment in the roll DOF. Other axes of motion may be included in the ride system that affect the passenger compartment in different DOFs such as pitch, yaw, and the like. These additional motions of the passenger compartment may be provided by actively or passively moving the passenger compartment in order to enhance the feeling of free swinging or to obtain a desired ride experience using the ride system described herein. All the actuated DOFs are tightly coordinated and synchronized (such as with a ride controller and its ride program or ride control module) in order to achieve a desired swinging sensation for the ride passengers/riders. For example, this synchronization may include providing a forward motion along the track that is fastest when the passenger compartment is in its lowest position (at bottom of swing arc with arm in smaller roll angle position) and providing a slower forward motion along the track when the passenger compartment is in its highest roll orientation (or range of higher roll angles for the pendulum arm).

We claim:

1. A swing ride apparatus, comprising:

a ride track;

a bogie coupled to the ride track, wherein the bogie includes a drive assembly operable to drive the bogie along a ride path defined by the ride track;

a pendulum arm pivotally coupled at a first end to the bogie, whereby the pendulum arm is suspended below the ride track and moves along the ride path with the bogie;

a passenger vehicle coupled to a second end of the pendulum arm opposite the first end of the pendulum arm; and a roll driver operable, concurrently with the drive assembly of the bogie, to rotate the pendulum arm about a roll axis extending through the first end of the pendulum arm, wherein the roll driver operates to repeatedly rotate the pendulum arm through a swing arc defined by a range of roll angles that is transverse to the ride path, whereby the ride vehicle is positioned on opposite sides of the ride path during movement through the swing arc; and wherein the drive assembly of the bogie is first operated to move the bogie in a first velocity range and second operated to move the bogie in a second velocity range less than the first velocity range, and wherein the roll driver is first operated to rotate the pendulum arm through a first roll angle range concurrently with the first operating of the drive assembly and is second operated, concurrently with the second operating of the drive assembly, to rotate the pendulum arm through a second roll angle range that is greater than the first roll angle range, whereby translational motion of the passenger vehicle is synchronized with roll.

2. The swing ride apparatus of claim 1, wherein the range of roll angles is 45 degrees clockwise (CW) to 45 degrees (CCW).

3. The swing ride apparatus of claim 1, wherein the range of roll angles is at least 15 degrees (CW) to 15 degrees (CCW).

4. The swing ride apparatus of claim 1, wherein the pendulum arm has a length as measured between the first and second ends that is at least 6 feet.

5. The swing ride apparatus of claim 1, wherein the ride track is flat and is free of banked corners.

6. The swing ride apparatus of claim 1, wherein the roll axis is parallel to a longitudinal axis of the ride track.

7. An apparatus for providing a swinging ride experience, comprising:

a track structure comprising an elevated track;

a powered bogie rollably engaging the elevated track;

a passenger vehicle with at least one seat for receiving and restraining a passenger;

an elongated arm pivotally supported at a first end and coupled to at a second end to the passenger vehicle;

a drive mechanism operable to rotate the elongated arm about a roll axis extending through the first end of the elongate arm in a CW direction and in a CCW direction; and a ride controller concurrently operating the powered bogie to move in a direction of travel on the elevated track and the drive mechanism to rotate the elongated arm in at least one of the CW and CCW directions, whereby the passenger vehicle has concurrent translational and roll motions, wherein the ride controller operates the powered bogie to have a velocity selected based on a current roll angle of the elongated arm, whereby translation motion of the passenger vehicle is synchronized with roll of the passenger vehicle, and wherein the elongated arm has a length as measured between the first and second ends that is at least 10 feet.

8. The apparatus of claim 7, wherein the roll axis is parallel to a longitudinal axis of the flat track.

9. The apparatus of claim 7, wherein the ride controller operates the drive mechanism to repeatedly rotate the elongated arm first in the CW direction and second in the CCW direction as the bogie is moved along the flat track, whereby the passenger vehicle is moved through a plurality of swing arcs.

10. The apparatus of claim 9, wherein each of the swing arcs is defined by a maximum CW roll angle and a maximum CCW roll angle and wherein the maximum CW and CCW roll angles are in the range of 45 and 115 degrees.

11. The apparatus of claim 7, wherein the ride controller operates the drive mechanism to rotate the elongated arm in a first range of roll velocities when the elongated arm is in a first range of roll angles and in a second range of roll velocities less than the first range or roll velocities when the elongated arm is in a second range of roll angles greater than the first range of roll angles.

12. A swing ride apparatus for use with an elevated ride track, comprising:

a bogie adapted for rollably engaging the ride track, wherein the bogie includes a drive assembly operable to drive the bogie along the ride track;

a pendulum arm pivotally coupled at a first end to the bogie via a pendulum support assembly, whereby the pendulum arm is suspended from the bogie and moves translationally with the bogie along the track;

a passenger vehicle coupled to a second end of the pendulum arm opposite the first end of the pendulum arm; and a roll driver operable to rotate the pendulum arm about a roll axis extending through the first end of the pendulum arm, wherein the ride track is flat and is free of banked corners, wherein the range of roll angles is at least 15 degrees (CW) to 15 degrees (CCW), wherein the drive assembly of the bogie is first operated to move the bogie in a first velocity range and second operated to move the bogie in a second velocity range less than the first velocity range, and wherein the roll driver is first operated to rotate the pendulum arm through a first roll angle range concurrently with the first operating of the drive assembly and is second operated, concurrently with the second operating of the drive assembly, to rotate the pendulum arm through a second roll angle range that is greater than the first roll angle range.

13. The swing ride apparatus of claim 12, wherein the pendulum arm has a length as measured between the first and second ends that is at least 10 feet.

14. The swing ride apparatus of claim 12, wherein the roll axis is parallel to a longitudinal axis of the ride track.

* * * * *